US008662326B2

(12) United States Patent
Brick

(10) Patent No.: US 8,662,326 B2
(45) Date of Patent: Mar. 4, 2014

(54) SHELVING UNIT

(76) Inventor: Stephanie Brick, New Hope, PA (US)

( * ) Notice: Subject to any disclaimer, the term of this patent is extended or adjusted under 35 U.S.C. 154(b) by 504 days.

(21) Appl. No.: 13/021,389

(22) Filed: Feb. 4, 2011

(65) Prior Publication Data

US 2012/0199541 A1 Aug. 9, 2012

(51) Int. Cl.
*A47B 47/00* (2006.01)

(52) U.S. Cl.
USPC ..... 211/186; 211/189

(58) Field of Classification Search
USPC ..... 211/74, 85.18, 189, 186; 108/158.12, 108/180; 312/107, 108; 52/668; D7/708, D7/619.1; 220/552
See application file for complete search history.

(56) References Cited

U.S. PATENT DOCUMENTS

| | | | | | |
|---|---|---|---|---|---|
| 213,848 | A | * | 4/1879 | Stevens | 217/32 |
| 2,366,677 | A | * | 1/1945 | Rosenthal | 108/60 |
| 2,837,216 | A | * | 6/1958 | Paige | 206/736 |
| 2,854,724 | A | * | 10/1958 | Wuorio | 249/168 |
| D208,921 | S | * | 10/1967 | Tapert | D6/473 |
| 3,600,792 | A | * | 8/1971 | Valluy et al. | 29/428 |
| 3,812,977 | A | | 5/1974 | Glassman | |
| 3,885,845 | A | * | 5/1975 | Krieks | 312/265 |
| 4,023,681 | A | | 5/1977 | Plant | |
| 4,153,311 | A | | 5/1979 | Takahashi | |
| 4,169,639 | A | * | 10/1979 | Zola | 312/265 |
| D268,463 | S | * | 4/1983 | Olson | D7/708 |
| 4,562,776 | A | | 1/1986 | Miranda | |
| 4,582,002 | A | * | 4/1986 | Wright | 108/60 |
| 4,715,503 | A | * | 12/1987 | Johnson | 211/74 |
| D311,629 | S | * | 10/1990 | Ragot | D1/126 |
| D317,991 | S | * | 7/1991 | Wightman | D7/708 |
| 6,283,564 | B1 | * | 9/2001 | Corson | 312/223.2 |
| 6,532,878 | B2 | | 3/2003 | Tidemann | |
| 6,595,378 | B2 | * | 7/2003 | Wang | 211/189 |
| 6,615,996 | B1 | * | 9/2003 | Ivey | 211/74 |
| 6,615,999 | B1 | | 9/2003 | Culp | |
| 6,845,871 | B1 | | 1/2005 | Culp | |
| D522,779 | S | * | 6/2006 | Ng et al. | D6/511 |
| 7,114,300 | B1 | | 10/2006 | Culp | |
| 7,856,772 | B1 | * | 12/2010 | Culp et al. | 52/211 |
| 2001/0037987 | A1 | * | 11/2001 | Culp | 211/186 |
| 2003/0010738 | A1 | * | 1/2003 | Hsia et al. | 211/188 |
| 2004/0099622 | A1 | * | 5/2004 | Lee | 211/85 |
| 2008/0308508 | A1 | | 12/2008 | Fischer | |
| 2009/0309464 | A1 | * | 12/2009 | Schwartz | 312/111 |

FOREIGN PATENT DOCUMENTS

| | | | |
|---|---|---|---|
| AU | 199870109 | A1 | 12/1998 |

* cited by examiner

*Primary Examiner* — Darnell Jayne
*Assistant Examiner* — Stanton L Krycinski
(74) *Attorney, Agent, or Firm* — Howson & Howson LLP

(57) ABSTRACT

A knock-down shelving unit is composed of four identical short panels, each having a slot extending perpendicularly from the middle of one edge to an inner end half way across the panel, and at least four longer panels, each having three similar slots. The parts of the panels extending from the inner ends of the slots to the opposite edges serve as connecting elements. The panels are interlocked by engaging the slots and connecting elements to form a lattice. In the lattice, where an end of a panel meets the end of another panel, a tongue formed on the end of each panel fits a recess formed in the end of the other panel. In an eight panel shelving unit, only two kinds of panels are required. In a shelving unit composed of ten or more panels, only three kinds of panels are required.

10 Claims, 4 Drawing Sheets

SHELVING UNIT

FIELD OF THE INVENTION

This invention relates to shelving, and more particularly to a shelving unit suitable for use as a bookcase or as a wine rack, or for various other purposes.

BACKGROUND OF THE INVENTION

Many individuals, especially college students, have a need for shelving to store books and other articles, and have frequent occasion to move a shelving unit from one location to another. For such individuals, a simple and inexpensive, but structurally sound, shelving unit that can be readily assembled and taken down is highly desirable.

Shelving units composed of interlocking slotted panels can achieve some of these objectives, and in some cases can be assembled without the need for screws or other fasteners. Examples of such shelving units are described in U.S. Pat. Nos. 3,812,977, 4,023,681, 4,153,311, 4,562,776, 6,532,878, 6,615,999, 6,845,871, and 7,114,300, in United States Patent Application Publication 2008/0308508, and in Australian Published Patent Application AU 199870109. In the shelving units described in these patents and publications, rigid panels having slots extending approximately half way across their widths are assembled by positioning adjacent panels in edge-to edge relationship with their faces respectively in mutually perpendicular planes and with slots in the adjacent panels in confronting relationship. Then, by sliding the panels together, the panels are interlocked with one another.

In some of these shelving units, for example the shelving units described in U.S. Pat. No. 7,114,300, the panels are disposed in an array in which some panels are vertical and others are horizontal. In other shelving units, for example the shelving units described in U.S. Pat. Nos. 3,812,977 and 4,023,681, and in U.S. Patent Publication 2008/0308508, the panels are disposed obliquely, at angles of 45° relative to the horizontal. Australian Published Patent Application AU199870109 describes a shelving system composed of a combination of vertical, horizontal, and oblique panels.

The shelving units composed of vertical and horizontal panels can be relatively simple and at the same time esthetically pleasing. However, the shelving units having oblique panels are generally more complex. For example, in U.S. Pat. No. 3,812,977, panels are hinged together at their ends, and form concave rectangular corners where the ends meet. In U.S. Pat. No. 4,023,681, specially formed strips attached to the inner walls of a rectangular box are used to receive the ends of oblique panels. In U.S. Patent Publication 2008/0308508, dovetail grooves in a base are provided to receive the ends of oblique panels where the panels meet one another. In Australian Published Patent Application AU 199870109, pairs of short slotted panels are interlocked to form x-shaped structures which fit into spaces in a rectangular array formed by interlocking longer slotted panels. The ends of the short panels are hidden in the corners of the spaces of the rectangular array.

SUMMARY OF THE INVENTION

The shelving unit according to the invention is composed of interlocking oblique panels, and is simpler than the prior art shelving units, potentially less expensive, and more easily assembled and taken down, yet structurally sound.

The shelving unit according to the invention comprises first and second sets of substantially rectangular panels. Each panel of the first set has first, second, third and fourth edges. The first and second edges are substantially equal in length and in opposed, parallel relationship. The third and fourth edges are also substantially equal in length and in opposed, parallel relationship. Each panel of the first set is formed with three slots, each having an opening in the first edge and extending perpendicularly from the first edge approximately half way across the panel toward the second edge. The three slots are located respectively ¼, ½, and ¾ the length of the panel from the third edge to the fourth edge. Consequently, quarter length portions of each of the panels are connected by connecting elements each having a length approximately equal to one half the length the third edge. Each panel of the second set also has first, second, third and fourth edges. The first and second edges of each panel of the second set are substantially equal in length and in opposed, parallel relationship. The third and fourth edges of each panel of the second set are also substantially equal in length and in opposed, parallel relationship. Each panel of the second set is formed with a single slot having an opening in the first edge and extending perpendicularly from the first edge approximately half way across the panel toward the second edge. The single slot in each panel of the second set is located midway between the third and fourth edges. Consequently, one half-length portions of each of the panels of the second set are connected by a central connecting element having a length approximately equal to one half the length of the third edge of the panel. The length of the first edge of each panel of the first set is substantially equal to twice the length of the first edge of each panel of the second set. The length of the third edge of each panel of the first set is substantially equal to the length of the third edge of each panel of the second set. The number of panels of the first set is a multiple of two, and the number of panels of the second set is four.

The panels of the first set are arranged in first and second groups. Each group consists of the same number of panels arranged in parallel relationship with one another and spaced by a distance equal to the distance between successive slots in the panels of the first set. The panels of the first group are disposed in perpendicular relationship to the panels of the second group and interlocked therewith by engagement of slots in panels of each group with connecting elements of panels of the other group to form a lattice. In the lattice one of the third and fourth edges of each of the panels of the first set is disposed in one of two imaginary parallel, preferably horizontal, planes from which each of the panels of the first set extends at a 45 degree angle. The other of the third and fourth edges of each of the panels of the first set are disposed in the other of the two imaginary parallel planes. Each of the panels of the second set is disposed in interlocked relationship with one of the panels of the first set by engagement of its single slot with a connecting portion of said one of said panels of the first set, and by engagement of its central connecting element with a slot of the last mentioned one of said panels of the first set. One of the third and fourth edges of each panel of the second set meets one of the third and fourth edges of one of the panels of the first set, and the other of the third and fourth edges of each panel of the second set meets one of the third and fourth edges of another of the panels of the second set.

In the simplest embodiment, the number of panels in the first set is four, and the panels of the first set can be substantially identical to one another, as can the panels of the second set.

Preferably, all of the panels have substantially the same thickness, and each of the panels of the first set is formed with a recess in one of its third and fourth edges. Each recess extends perpendicularly from the first edge approximately half way across the panel toward the second edge, and each recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness.

Each of the panels of the second set is formed with a recess in each of its third and fourth edges. Each such recess extends perpendicularly from the first edge approximately half way across the panel toward the second edge, and each recess has a depth, in the direction from the edge in which it is formed toward the opposite edge, substantially equal to the panel thickness. As in the case of the panels of the first set, a tongue is formed adjacent the recess, the tongue extending in the direction away from the opposite edge by a distance substantially equal to the panel thickness.

At each location at which an edge of a panel of the second set meets an edge of one of the panels of the first set, a tongue on each of the meeting edges fits into a recess in the other of the meeting edges.

In another embodiment, the number of panels in the first set is at least six. Here, as in the first embodiment, all of the panels preferably have substantially the same thickness. In this case, the panels of the first set are equally divided into first and second groups of at least three panels each. Each such group consists of two endmost panels and at least one intermediate panel situated between the endmost panels. Each of the endmost panels is formed with a recess in only one of its third and fourth edges. Each recess extends perpendicularly from the first edge approximately half way across the panel toward the second edge, and each recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness.

Each of the intermediate panels in the first and second groups is formed with a recess in each of its third and fourth edges. Each of these recesses extends perpendicularly from the first edge approximately half way across the panel toward the second edge, and each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness.

Each of the panels of the second set is formed with a recess in each of its third and fourth edges. Each such recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness. At each location at which an edge of a panel of the second set meets an edge of one of the panels of the first set, a tongue on each of the meeting edges fits into a recess in the other of the meeting edges, and, at each location at which an edge of a panel of the first set meets an edge of another one of the panels of the first set, a tongue on each of the meeting edges fits into a recess in the other of the meeting edges. The meeting of the panel edges with one another helps to maintain the panels, especially the panels of the second set, which have only a single, centrally located slot, in rigid relationship to the other panels. The interlocking engagement of the tongues and recesses at the panel edges further enhances the stability of the shelving unit.

In the second embodiment, the endmost panels are preferably substantially identical to one another, the intermediate panels are substantially identical to one another, and the panels of the second set are also substantially identical to one another.

In both embodiments, all of the panels preferably have substantially the same thickness, and the width of each of the slots is preferably substantially equal to the panel thickness.

The shelving unit according to the invention, in its various embodiments, has one or more of the following advantages: simplicity, low cost, a relatively small number of parts, a small number (usually only 2 or 3) of groups of identical parts, avoidance of fasteners such as screws, bolts, and the like, ease of assembly and disassembly, compact stowage of parts, and the ability of the parts to be manufactured efficiently and with a relatively small amount of waste.

Further advantages of the invention will be apparent from the following description when read in conjunction with the drawings.

DETAILED DESCRIPTION OF THE PREFERRED EMBODIMENTS

Figure 1:
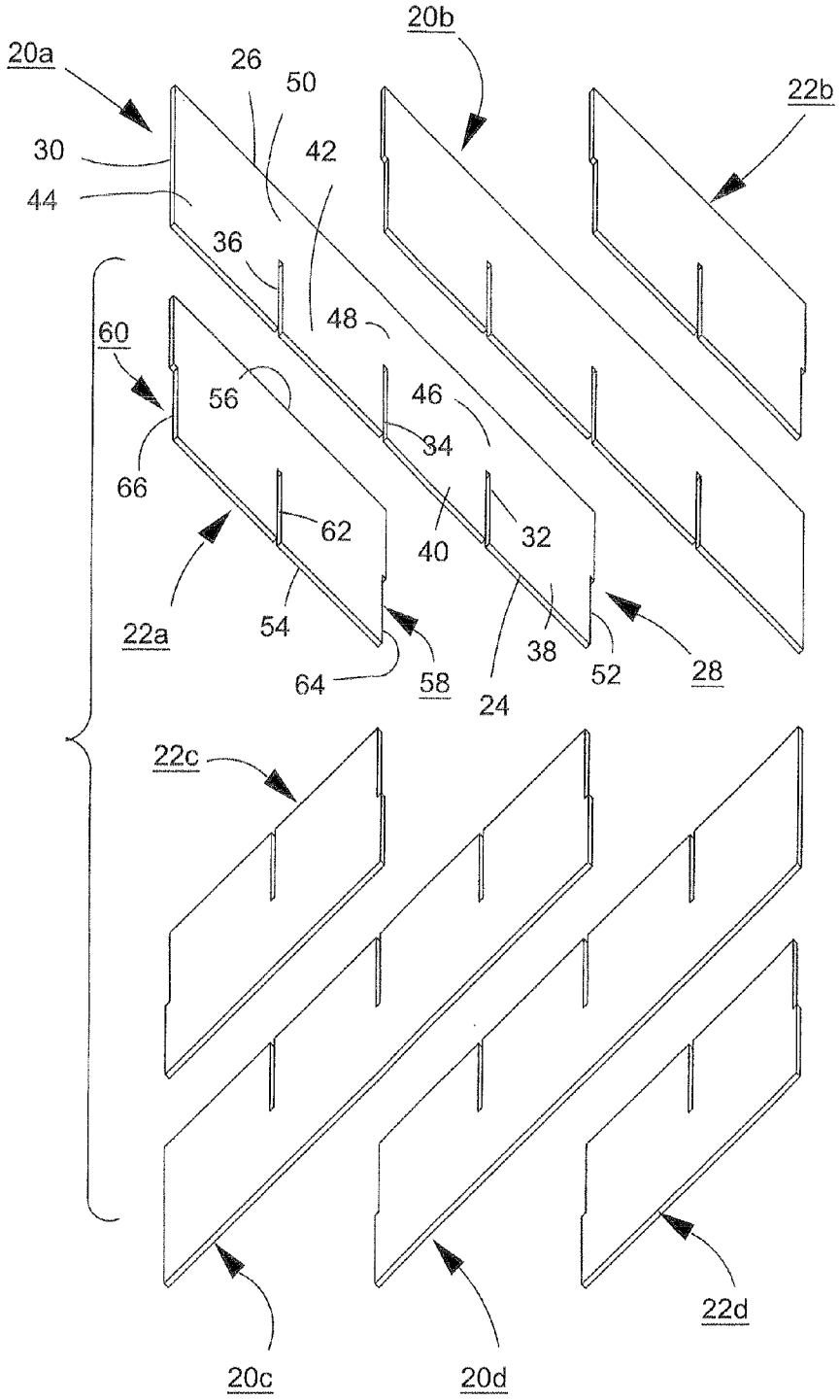
FIG. 1 is an exploded perspective view of a shelving unit according to a first embodiment of the invention showing the individual components.

FIGS. 1-4 illustrate the first embodiment, in which the shelving unit is composed of only two different kinds of panels. As shown in exploded view in FIG. 1, the shelving unit is made up of a first set of four identical, substantially rectangular, panels 20*a*, 20*b*, 20*c* and 20*d*, and a second set of identical, substantially rectangular, panels 22*a*, 22*b*, 22*c*, and 22*d*. The panels of the first set are substantially twice as long as the panels of the second set. These panels can be composed of any of a variety of materials such as wood, plywood, compressed wood fiber, or any of a variety of plastics such as PVC and ABS.

Panel 20*a* is illustrative of the panels of the first set. It has a first edge 24 and a second edge 26. Edges 24 and 26 are substantially equal in length, and in opposed, parallel relationship. As will be apparent, however, in the embodiment shown, edge 26 is slightly longer than edge 24 because edge 24 is formed with a recesses at one end, which will be described. A third edge 28 and a fourth edge 30 are also substantially equal in length and in opposed, parallel relationship. In this embodiment, edges 24 and 26 are longer than edges 28 and 30. First edge 24 has three slots 32, 34, and 36. Each of these slots has an opening in the first edge 24 and extends perpendicularly from edge 24 approximately half way across the panel toward the second edge 26. Slot 32 is located approximately ¼ the length of the panel from the third edge 28 to the fourth edge 30. Slot 34 is located approximately ½ the length of the panel from the third edge 28 to the fourth edge 30, and slot 36 is located approximately ¾ the length of the panel from the third edge 28 to the fourth edge 30. Consequently the panel is divided into four, approximately quarter length, portions 38, 40, 42 and 44. Portions 38 and 40 are connected by a connecting element 46. Portions 40 and 42 are connected by a connecting element 48, and portions 42 and 44 are connected by a connecting element 50. Each of these connecting elements 46, 48 and has a length, measured in a direction parallel to the third edge 28, approximately equal to one half the length of the third edge 28, i.e., one-half the distance from the first edge 24 to the second edge 26. In the embodiment shown, the part of edge 24 extending from slot 36, and edge 30 is slightly longer than the other three parts of edge 24, by an amount corresponding to the width of a slot.

The fourth edge 30 of panel 20*a* is straight. The third edge 28, however, is formed with a rectangular recess 52 that extends from edge 24 toward edge 26, about half way across the panel. The width of recess 52 is preferably the same as the width of each of slots 32, 34, and 36.

Panel 22*a* is illustrative of the panels of the second set. Panel 22*a* has a first edge 54, a second edge 56, opposite from, and parallel to, the first edge, and third and fourth edges 58 and 60. A slot 62, extends perpendicularly from a mid-point of edge 54 about half way across the panel toward edge 56. Edges 58 and 60 of panel 22*a* have rectangular recesses 64 and 66, respectively similar to the recess 52 at edge 28 of panel 20*a*. These recesses extend from edge 54 approximately half the distance toward edge 56. Thus, in this embodiment, each of panels 20*a*-20*d* has a recess at only one end while each of panels 22*a*-22*d* has recesses at both ends.

Figure 2:
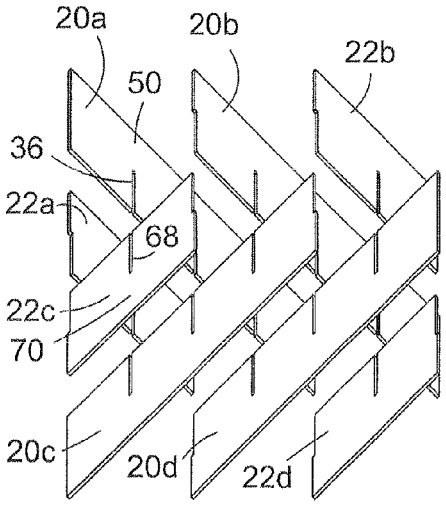
FIGS. 2 and 3 are perspective views showing successive stages in the assembly of the shelving unit.
Figure 3:
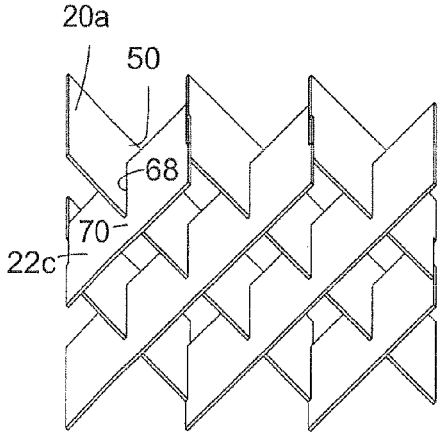

As shown in FIG. 2, the panels 22*c*, 20*c*, 20*d* and 22*d* are arranged parallel to, and uniformly spaced from, one another with the longer panels 20*c* and 20*d* between the shorter panels 22*c* and 22*d*. Panels 22*a*, 20*a*, 20*b* and 22*b* are similarly arranged parallel to one another with the longer panels between the shorter panels. The faces of the panels of each of these two groups of panels are disposed at a 90 degree angle to the faces of the panels of the other group, and the slots of the panels are in opposed relationship so that each connecting part of each panel can be received in a slot of a panel from the other group as shown in FIG. 3. By way of example, connecting part 50 of panel 20*a* is received in slot 68 of panel 22*c*. At the same time, connecting part 70 of panel 22*c* is received in slot 36 of panel 20*a*.

Figure 4:
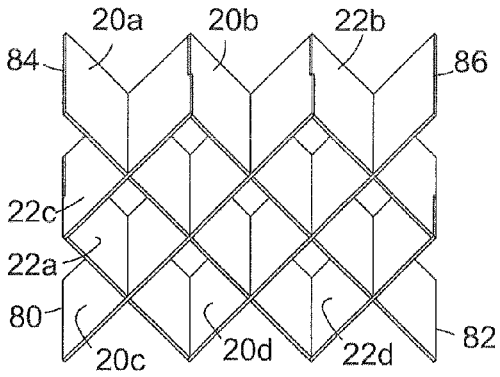
FIG. 4 is a perspective view of a fully assembled shelving unit according to the first embodiment.

When the assembly is completed, as shown in FIG. 4, the forward edges of panels 22*a*, 20*a*, 20*b*, and 22*b*, are flush with the forward edges of panels 22*c*, 20*c*, 20*d* and 22*d*, and the rearward edges are similarly in flush relationship. The panels form a rigid structure having seven closed, rectangular spaces that can be used to store books, papers and other articles. Articles can also be placed on the three V-shaped recesses formed at the top of the structure.

It should be understood that the arrangements of panels in FIGS. 1-3 are for illustrative purposes, and that the assembly of the shelving unit will ordinarily be carried out in steps, by addition of one panel at a time, rather than by simultaneous engagement of plural panels of one group with all the panels of the other group of opposed slots. The order in which the panels are assembled is unimportant.

Figure 5:
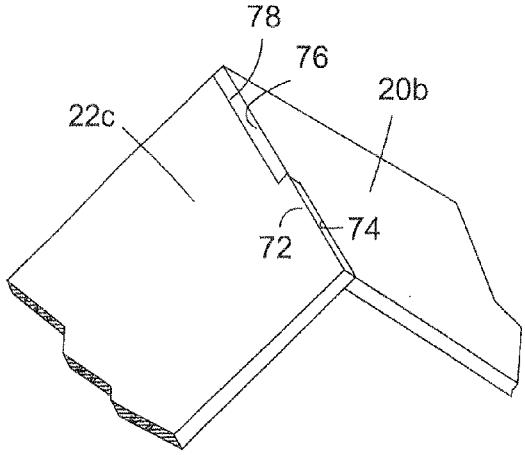
FIG. 5 is a fragmentary perspective view showing details of the manner in which ends of panels of the shelving unit are joined.

The part of the end of each panel adjacent a recess forms a tongue which is received in a recess of an adjoining panel. Thus, as shown in FIG. 5, which shows the joint at which the upper end of panel 22*c* meets the upper end of panel 20*b*, a tongue 72 on panel 22*c* fits a recess 74 of panel 20*b*. Similarly tongue 76 of panel 20*b* fits a recess 78 of panel 22*c*. If the depths of the recesses is equal to the thicknesses of the panels, a clean joint is formed in which two adjacent tongues are aligned with each other and form a corner line of the panel joint. Other more elaborate joints, such as mortise and tenon joints, and dovetail joints, can be utilized, but are unnecessary. The single recess and single tongue at an end of a panel provides a suitable joint, and is much simpler.

The structure shown in FIG. 4 is composed of four identical short panels, each having a single intermediate slot and recesses at both ends, and four identical long panels, each having three slots and a recess at only one end. The free ends of the panels, e.g., the lower ends 80 and 82 of panels 20*c* and 20*b* and the upper ends 84 and 86 of panels 20*a* and 20*d*, are formed without recesses and tongues. Because the lower ends 80 and 82 have no recesses, and because the joint at the lower ends of panels 22*a* and 20*d* and the joint at the lower ends of panels 20*a* and 22*d* form a straight edge, the assembly can rest in a stable manner on a floor. The embodiment shown in FIGS. 1-4 is simple because it is composed of only two kinds of panels, and the panels can be reversible, i.e., both faces of each panel can be identical. No special skill is required for its assembly, and it is only necessary to ensure that the long panels are disposed with their recessed ends in the proper position.

Figure 6:
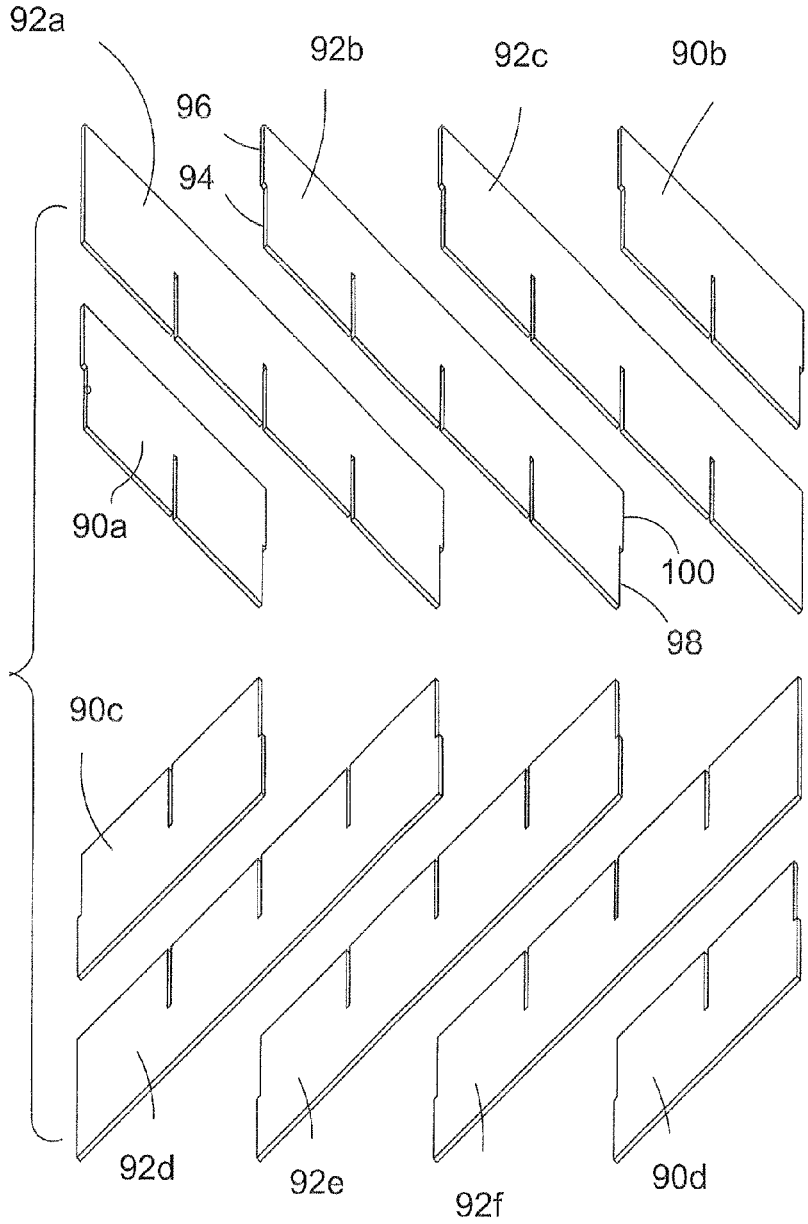
FIG. 6 is an exploded perspective view of a shelving unit according to a second embodiment of the invention showing individual components.
Figure 7:
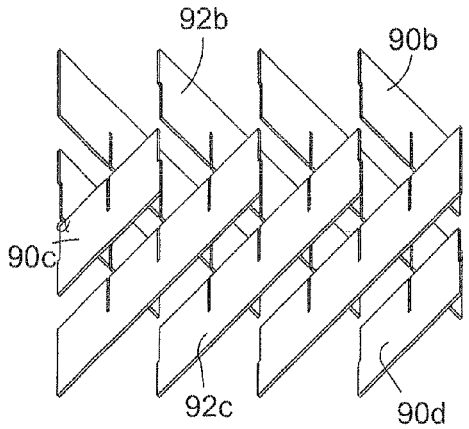
FIGS. 7 and 8 are perspective views showing successive stages in the assembly of the shelving unit of the second embodiment.
Figure 8:
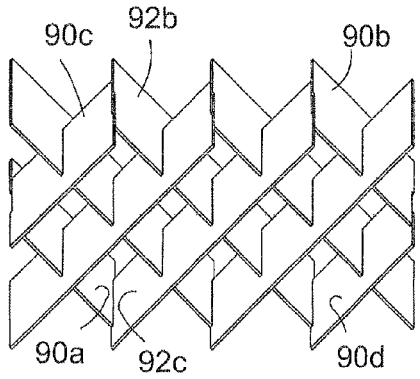
Figure 9:
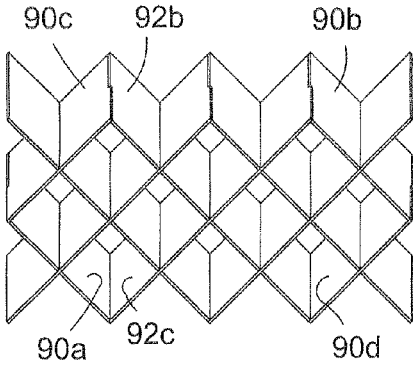
FIG. 9 is a perspective view of a fully assembled shelving unit according to the second embodiment.

In another embodiment, shown in FIGS. 6-9, the shelving unit is composed of four short panels 90*a*, 90*b*, 90*c*, and 90*d*, and six long panels 92*a*, 92*b*, 92*c*, 92*d*, 92*e* and 92*f*. As will be apparent from FIGS. 7-9, the shelving unit of this embodiment is a horizontally extended version of the shelving unit of FIG. 4 having two additional long panels, 92*b* and 92*e*. Both ends of these additional panels meet other panels, and accordingly unlike the other long panels, panels 92*b* and 92*e* have recesses and tongues at both ends. For example, as shown in FIG. 6, panel 92*b* has a recess 94 and a tongue 96 at its upper end and a recess 98 and a tongue 100 at its lower end. Panel 92*e* similarly has recesses and tongues at both ends. As shown in FIG. 9, the upper end of panel 92*b* meets the upper end of short panel 90*c* and the lower end of panel 92*b* meets the lower end of short panel 90*d*. Similarly, the upper end of panel 92*e* meets the upper end of short panel 90*b* and the lower end of panel 92*e* meets the lower end of panel 90*a*. At the locations at which these panel ends meet, the relationship of the tongues and recesses is substantially the same as the relationship shown in FIG. 5.

Still longer shelving units can be constructed by adding pairs of panels, similar to panels 92*b* and 92*e*, having recesses and tongues at both ends. Each shelving unit will be composed of four short panels, each having a single intermediate slot, and a number of long panels each having three slots, the number being a multiple of two. Each of the short panels should have a recess and a tongue at both ends. Four of the long panels should have a recess and tongue at only one end. Any additional panels should have a recess and a tongue at both ends.

Figure 10:
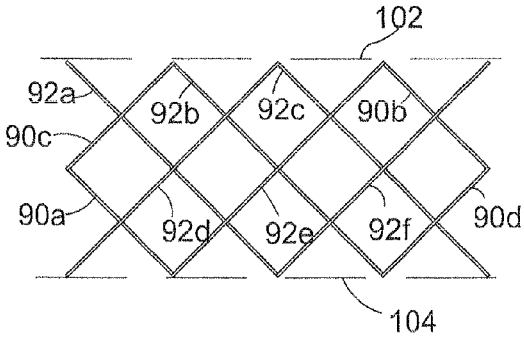
FIG. 10 is a front elevational view of the shelving unit of FIGS. 6-9.

As shown in FIG. 10, which is an elevational view of the shelving unit of FIG. 9, panels 90*a*, 92*a*, 92*b*, 92*c* and 90*b* constitute a first group of parallel panels, and panels 90*c*, 92*d*, 92*e*, 92*f* and 90*d* constitute a second group of parallel panels. The panels of the first group are disposed in perpendicular relationship to the panels of the second group and interlocked therewith by engagement of slots in panels of each group with connecting elements of panels of the other group to form a lattice. The ends of each of the long panels are disposed respectively in one of two imaginary parallel planes 102 and 104, from which each of the long panels extends at a 45 degree angle. The ends of the long panels of the eight panel embodiment of FIG. 4, and the ends of the long panels in extended embodiments (not shown), are similarly disposed in parallel imaginary planes.

The parallel planes need not be horizontal. For example, the unit in FIG. 10 can be rotated 90 degrees so that it stands on one of its ends and the imaginary parallel planes 102 and 104 are vertical. Other embodiments can be rotated in a similar manner.

The dimensions of the panels can be varied, depending on the intended application of the shelving unit. For example in the case of a bookshelf with square openings, the sides of the squares should be at least as long as the height of the largest book for which the shelving unit is intended. Where the shelving unit is intended for use as a shoe rack, each square opening should accommodate a single pair of shoes. Where the shelving unit is to be used as a wine rack, the rectangular openings can be of a size to receive a 0.75 or 1.5 liter wine bottle, and the widths of the panels should approximate the height of a wine bottle. In the case of a wine rack, the widths of the shorter panels, i.e., their front to back dimension, can be equal to or greater than their lengths.

The shelving unit has among its advantages the fact that it can be assembled and taken down quickly and easily without the need for fasteners, and the fact that its parts can lie flat and can therefore be packaged and shipped easily. In the case of the eight panel embodiment, only two different kinds of panels are required, and, in the case of an embodiment having 10 or more panels, only three different kinds of panels are required.

Numerous modifications can be made to the shelving Unit. As mentioned previously, although the tongues and recesses described are preferred, some of the advantages of the invention can be realized in versions in which, instead of the tongue and recess joints, other joints such as mortise and tenon or dovetail joints are utilized. Although, for simplicity and strength, it is preferred that the widths of the slots be equal to the panel thickness, it is possible to narrow the widths of the panels at the locations of their, connecting parts, e.g., connecting part 50 (FIG. 1), and to make the slots correspondingly narrower. The various other modifications can be made without departing from the scope of the invention as defined in the following claims.

What is claimed is:

1. A shelving unit comprising:

a first set of substantially rectangular panels, each panel of the first set having first, second, third and fourth edges, the first and second edges being substantially equal in length and in opposed, parallel relationship, and the third and fourth edges also being substantially equal in length and in opposed, parallel relationship, and each panel of the first set being formed with three slots, each slot having an opening in the first edge and extending perpendicularly from the first edge approximately half way across the panel toward the second edge, said slots being located respectively ¼, ½, and ¾ the length of the panel from the third edge to the fourth edge, whereby quarter length portions of each of the panels of the first set are connected by connecting elements each having a length approximately equal to one half the length of the third edge; and a second set of substantially rectangular panels, each panel of the second set also having first, second, third and fourth edges, the first and second edges of each panel of the second set being substantially equal in length and in opposed, parallel relationship, and the third and fourth edges of each panel of the second set also being substantially equal in length and in opposed, parallel relationship, and each panel of the second set being formed with a single slot having an opening in the first edge and extending perpendicularly from the first edge approximately half way across the panel toward the second edge, said single slot being located midway between the third and fourth edges, whereby one half-length portions of each of the panels of the second set are connected by a central connecting element having a length approximately equal to one half the length of the third edge of the panel;

wherein the length of the first edge of each panel of the first set is substantially twice the length of the first edge of each panel of the second set;

wherein the length of the third edge of each panel of the first set is substantially equal to the length of the third edge of each panel of the second set;

wherein the number of panels of the first set is a multiple of two and the number of panels of the second set is four;

wherein the panels of the first set are arranged in first and second groups, each said group consisting of the same number of panels arranged in parallel relationship with one another and spaced by a distance equal to the distance between successive slots in the panels of the first set;

wherein the panels of the first group are disposed in perpendicular relationship to the panels of the second group and interlocked therewith by engagement of slots in panels of each group with connecting elements of panels of the other group to form a lattice in which one of the third and fourth edges of each of the panels of the first set is disposed in one of two imaginary parallel planes from which each of the panels of the first set extends at a 45 degree angle and with the other of the third and fourth edges of each of the panels of the first set being disposed in the other of said two imaginary parallel planes;

wherein each of the panels of the second set is disposed in interlocked relationship with one of the panels of the first set by engagement of its single slot with a connecting portion of said one of said panels of the first set, and by engagement of its central connecting element with a slot of the last mentioned one of said panels of the first set;

wherein one of the third and fourth edges of each panel of the second set meets one of the third and fourth edges of one of the panels of the first set, and the other of the third and fourth edges of each panel of the second set meets one of the third and fourth edges of another of the panels of the second set;

wherein all of the panels have substantially the same thickness;

wherein each of the panels of the first set is formed with a recess in one of its third and fourth edges, each said recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness;

wherein each of the panels of the second set is formed with a recess in each of its third and fourth edges, each said recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness, wherein, at each location at which an edge of a panel of the second set meets an edge of one of the panels of the first set, the tongue on each of the meeting edges fits into the recess in the other of the meeting edges;

wherein the number of panels in the first set is four and wherein each said tongue on each of said meeting edges is held in a recess in the other of said meeting edges solely by the interlocked relationship of the panels of the first group with the panels of the second group and the interlocked relationship of the panels of the first set with the panels of the second set.

2. A shelving unit according to claim 1, in which the panels of the first set are substantially identical to one another, and in which the panels of the second set are also substantially identical to one another.

3. A shelving unit comprising:

a first set of substantially rectangular panels, each panel of the first set having first, second, third and fourth edges, the first and second edges being substantially equal in length and in opposed, parallel relationship, and the third and fourth edges also being substantially equal in length and in opposed, parallel relationship, and each panel of the first set being formed with three slots, each slot having an opening in the first edge and extending perpendicularly from the first edge approximately half way across the panel toward the second edge, said slots being located respectively ¼, ½, and ¾ the length of the panel from the third edge to the fourth edge, whereby quarter length portions of each of the panels of the first set are connected by connecting elements each having a length approximately equal to one half the length of the third edge; and a second set of substantially rectangular panels, each panel of the second set also having first, second, third and fourth edges, the first and second edges of each panel of the second set being substantially equal in length and in opposed, parallel relationship, and the third and fourth edges of each panel of the second set also being substantially equal in length and in opposed, parallel relationship, and each panel of the second set being formed with a single slot having an opening in the first edge and extending perpendicularly from the first edge approximately half way across the panel toward the second edge, said single slot being located midway between the third and fourth edges, whereby one half-length portions of each of the panels of the second set are connected by a central connecting element having a length approximately equal to one half the length of the third edge of the panel;

wherein the length of the first edge of each panel of the first set is substantially twice the length of the first edge of each panel of the second set;

wherein the length of the third edge of each panel of the first set is substantially equal to the length of the third edge of each panel of the second set;

wherein the number of panels of the first set is a multiple of two and the number of panels of the second set is four;

wherein the panels of the first set are arranged in first and second groups, each said group consisting of the same number of panels arranged in parallel relationship with one another and spaced by a distance equal to the distance between successive slots in the panels of the first set;

wherein the panels of the first group are disposed in perpendicular relationship to the panels of the second group and interlocked therewith by engagement of slots in panels of each group with connecting elements of panels of the other group to form a lattice in which one of the third and fourth edges of each of the panels of the first set is disposed in one of two imaginary parallel planes from which each of the panels of the first set extends at a 45 degree angle and with the other of the third and fourth edges of each of the panels of the first set being disposed in the other of said two imaginary parallel planes;

wherein each of the panels of the second set is disposed in interlocked relationship with one of the panels of the first set by engagement of its single slot with a connecting portion of said one of said panels of the first set, and by engagement of its central connecting element with a slot of the last mentioned one of said panels of the first set;

wherein one of the third and fourth edges of each panel of the second set meets one of the third and fourth edges of one of the panels of the first set, and the other of the third and fourth edges of each panel of the second set meets one of the third and fourth edges of another of the panels of the second set;

wherein the number of panels in the first set is at least six;

wherein all of the panels have substantially the same thickness;

wherein each of the first and second groups consists of two endmost panels and at least one intermediate panel situated between the endmost panels;

wherein each of the endmost panels of the first and second groups is formed with a recess in only one of its third and fourth edges, each said recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness;

wherein each of the intermediate panels in the first and second groups is formed with a recess in each of its third and fourth edges, each said recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness;

wherein each of the panels of the second set is formed with a recess in each of its third and fourth edges, each said recess extends perpendicularly from the first edge approximately half way across the panel toward the second edge, each said recess has a depth, in the direction from the edge in which it is formed toward the opposite edge, substantially equal to the panel thickness, whereby a tongue is formed adjacent the recess, the tongue extending in the direction away from the opposite edge by a distance substantially equal to the panel thickness;

wherein, at each location at which an edge of a panel of the second set meets an edge of one of the panels of the first set, a tongue on each of the meeting edges fits into a recess in the other of the meeting edges: and wherein, at each location at which an edge of a panel of the first set meets an edge of another one of the panels of the first set, the tongue on each of the meeting edges fits into the recess in the other of the meeting edges; and wherein each said tongue on each of said meeting edges is held in a recess in the other of said meeting edges solely by the interlocked relationship of the panels of the first group with the panels of the second group and the interlocked relationship of the panels of the first set with the panels of the second set.

4. A shelving assembly according to claim 3, in which said endmost panels are substantially identical to one another, said intermediate panels are substantially identical to one another, and the panels of the second set are also substantially identical to one another.

5. A shelving assembly according to claim 1, in which said first and second imaginary planes are horizontal.

6. A shelving assembly according to claim 1, in which all of the panels have substantially the same thickness, and in which the width of each of the slots is substantially equal to the panel thickness.

7. A shelving unit according to claim 1, in which the panels of the first set are substantially identical to one another, and in which the panels of the second set are also substantially identical to one another.

8. A shelving assembly according to claim 3, in which said first and second imaginary planes are horizontal.

9. A shelving assembly according to claim 3, in which all of the panels have substantially the same thickness, and in which the width of each of the slots is substantially equal to the panel thickness.

10. A shelving unit according to claim 3, in which the panels of the first set are substantially identical to one another, and in which the panels of the second set are also substantially identical to one another.

* * * * *